US009095185B1

(12) United States Patent
Ortner

(10) Patent No.: US 9,095,185 B1
(45) Date of Patent: Aug. 4, 2015

(54) SHOES WITH INTERCHANGEABLE DECORATIVE APPLIQUÉS

(76) Inventor: Dina Ortner, Lakewood, NJ (US)

( * ) Notice: Subject to any disclaimer, the term of this patent is extended or adjusted under 35 U.S.C. 154(b) by 80 days.

(21) Appl. No.: 13/246,252

(22) Filed: Sep. 27, 2011

Related U.S. Application Data

(63) Continuation-in-part of application No. 12/166,638, filed on Jul. 2, 2008, now abandoned.

(51) Int. Cl.

| | |
|---|---|
| ***A43B 1/10*** | (2006.01) |
| ***A43B 23/00*** | (2006.01) |
| ***A43B 3/00*** | (2006.01) |
| ***A43B 3/24*** | (2006.01) |

(52) U.S. Cl.
CPC ..... *A43B 3/0078* (2013.01); *A43B 3/242* (2013.01)

(58) Field of Classification Search
CPC ..... A43B 3/24; A43B 3/242; A43B 3/0078; A43B 23/24
USPC ..... 36/1, 101, 100, 136
See application file for complete search history.

(56) References Cited

U.S. PATENT DOCUMENTS

| | | | | |
|---|---|---|---|---|
| 900,499 | A | 10/1908 | Eckhard, Jr. | |
| 1,463,531 | A * | 7/1923 | Kennedy | 36/34 R |
| 2,079,331 | A | 5/1937 | Nyhagen | |
| 2,583,826 | A * | 1/1952 | Fischer | 36/11.5 |
| 2,801,477 | A * | 8/1957 | Adams et al. | 40/636 |
| 2,915,836 | A * | 12/1959 | McDonough | 36/72 B |
| 2,292,770 | A | 8/1972 | Platkin | |
| 3,994,080 | A * | 11/1976 | Flanagan et al. | 36/100 |
| 4,333,248 | A | 6/1982 | Samuels | |
| 5,233,768 | A | 8/1993 | Humphreys | |
| 5,800,900 | A * | 9/1998 | Mitchell | 428/100 |
| 5,896,684 | A | 4/1999 | Lin | |
| 5,976,100 | A | 11/1999 | Greenawalt | |
| 5,996,258 | A | 12/1999 | Simmons | |
| 6,115,948 | A * | 9/2000 | Mitchell | 36/136 |
| 6,360,457 | B1 | 3/2002 | Qui et al. | |
| 6,430,846 | B1 | 8/2002 | Lin | |
| 6,455,128 | B1 * | 9/2002 | Moon | 428/138 |
| 6,874,256 | B2 | 4/2005 | Delgatty | |
| 6,981,340 | B2 | 1/2006 | Evans | |
| 7,028,420 | B2 | 4/2006 | Tonkel | |
| 7,296,367 | B2 | 11/2007 | Kipnes | |
| 7,661,206 | B2 | 2/2010 | Osborn | |
| D634,105 | S * | 3/2011 | Cheshire et al. | D2/925 |
| 2003/0177664 | A1 * | 9/2003 | Monassebian | 36/100 |
| 2004/0093765 | A1 | 5/2004 | Baldwin | |

(Continued)

FOREIGN PATENT DOCUMENTS

| | | |
|---|---|---|
| EP | 1.749.454 | 2/2007 |
| WO | WO2008007403 | 1/2008 |

*Primary Examiner* — Jila M Mohandesi
*Assistant Examiner* — Katharine Gracz
(74) *Attorney, Agent, or Firm* — Michael I. Kroll

(57) ABSTRACT

Shoes having receptacles for the placement therein of replaceable decorative appliqués whereby the style of the shoe can be changed as desired by the user. The shoe and top, side and rear covers have corresponding fasteners for releasably fixing the decorative appliqué to the shoe whereby the removable appliqué can be swapped with different colors and textures to create interesting new looks using the same base shoe. Integral interior magnets also apply magnetic therapy to the foot within each shoe.

5 Claims, 22 Drawing Sheets

(56) References Cited

U.S. PATENT DOCUMENTS

2005/0016026 A1* 1/2005 Long ..... 36/101
2005/0016028 A1* 1/2005 Safdeye ..... 36/132
2005/0066550 A1* 3/2005 Liu ..... 36/101
2006/0143951 A1* 7/2006 Yang et al. ..... 36/100
2007/0068045 A1 3/2007 Condie
2009/0100714 A1* 4/2009 Coger ..... 36/100
2009/0151202 A1 6/2009 Kramer et al.
2009/0193684 A1 8/2009 Diamond

* cited by examiner

SHOES WITH INTERCHANGEABLE DECORATIVE APPLIQUÉS

This application is a Continuation-In-Part of U.S. patent application Ser. No. 12/166,638, having a filing date 2 Jul. 2008 now abandoned.

BACKGROUND OF THE INVENTION

1. Related Applications

Please incorporate by reference all information in said patent applications into this continuation-in-part application.

2. Field of the Invention

The present invention relates generally to shoes and, more specifically, to shoes having replaceable decorative members whereby the style of the shoe can be changed as desired by the user.

Shoes are typically composed of a sole and an upper. The sole includes the outsole and insole with the upper composed of exterior components, typically a vamp forming the front of the shoe covering the toes and part of the foot and quarters extending from the vamp to the back of the shoe and an interior lining, which for the purposes of the instant invention are referred to as the vamp lining and the quarter lining.

The present invention is a shoe having multiple changeable top, side and rear decorative appliqués providing for changing the style and appearance of a shoe, whereby a user can selectively replace the top, side or rear decorative appliqués from a plurality of top, side or rear decorative appliqués.

The shoe and top cover have attachment means for releasably fixing said top, side and rear cover to said shoe. The removable top, side and rear can be swapped with different appliqués of varying colors and textures to create interesting new looks using the same base shoe.

The present invention further provides that the shoe can have an open toe with a plurality of toe covers providing means for changing the shoe appearance using any appropriate fastener taken from the group of hook and loop, snap, hook, zipper or magnet for attaching the toe cover or appliqués to the shoe.

DESCRIPTION OF THE PRIOR ART

There are other shoes designed with replaceable elements. While these shoes may be suitable for the purposes for which they were designed, they would not be as suitable for the purposes of the present invention, as hereinafter described.

SUMMARY OF THE PRESENT INVENTION

A primary object of the present invention is to provide shoes having a plurality of decorative appliqué whereby the appearance and style of the shoe can be selectively changed at the user's discretion.

Another object of the present invention is to provide a shoe having a recess within the vamp and/or quarters for placement of a decorative appliqué therein.

Yet another object of the present invention is to provide a shoe where said recess has a depth substantially corresponding to the thickness of the appliqué base.

Still yet another object of the present invention is to provide a decorative appliqué having a base that is substantially similar in shape to the recess manufactured in the vamp and/or quarter.

An additional object of the present invention is to provide a shoe wherein said recess extends through the vamp and/or quarter.

A further object of the present invention is to provide a decorative appliqué with a base having a top side and a bottom side.

A yet further object of the present invention is to provide a decorative appliqué having a fastener fixedly attached to the base of said decorative appliqué.

A still yet further object of the present invention is to provide said vamp and/or quarter recess with a mating fastener to said decorative appliqué base fastener.

Another object of the present invention is to provide a vamp and/or quarter lining with a fastener when said recess passes through said vamp and/or said quarter.

Yet another object of the present invention is to provide a decorative appliqué that when placed within said manufactured recess in said vamp or said quarters, the top surface of the decorative appliqué base is coplanar with the exterior surface of said shoe vamp and/or shoe quarter.

Still yet another object of the present invention is to provide toe covers for an open toe shoe vamp having corresponding fastener member forming an integral part therewith whereby the toe cover can be releasably attached to an open toe aperture An additional object of the present invention is to provide a plurality of decorative appliqués having a base with ornamental articles projecting therefrom.

A further object of the present invention is to provide a decorative appliqué wherein said ornamental articles includes ribbons, bows, beads, sequins, shells, jewels, tassels, etc.

A yet further object of the present invention is to provide a decorative appliqué having a base with a top surface of various colors, patterns and textures.

Another object of the present invention is to provide a shoe having a plurality of decorative appliqués and toe covers with fasteners taken from the group of hook and loop, zippers, snaps, hooks and magnets.

Yet another object of the present invention is to provide shoe toe covers whereby the appearance of the shoe can be changed by replacing the toe cover selected from a plurality of provided toe covers.

Additional objects of the present invention will appear as the description proceeds.

The present invention overcomes the shortcomings of the prior art by providing shoes having recesses within the shoe vamp or shoe quarters and toe covers for open toe shoes whereby the style of the shoe can be changed as desired by the user.

The shoe's decorative appliqués and toe covers have fasteners for releasably fixing the decorative appliqués within shoe recesses and toe cover appliqués mountable to the shoe insole whereby any one or all of said decorative appliqués can be swapped with different appliqués of varying colors and textures to create interesting new looks using the same base shoe.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
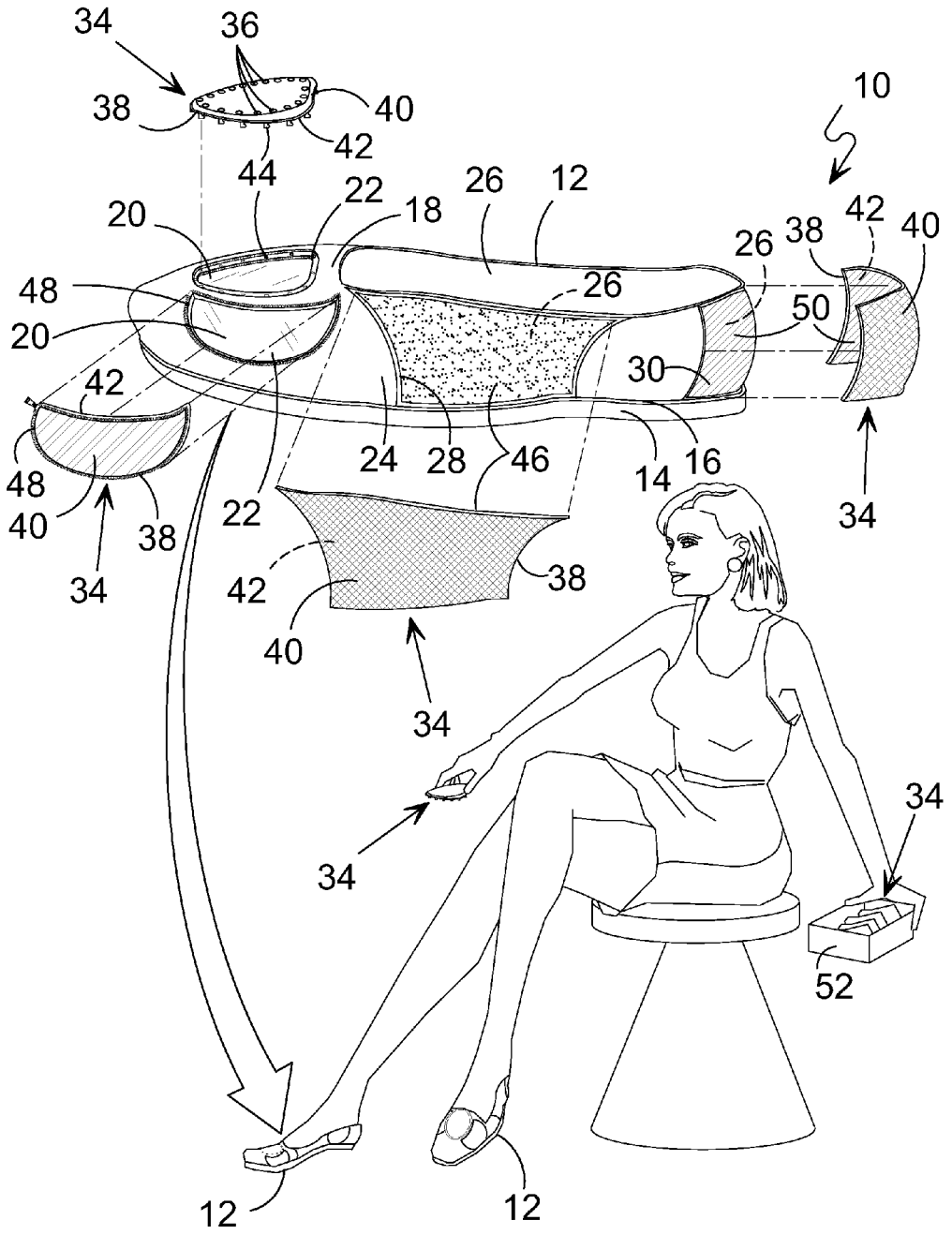
FIG. 1 is an illustrative view of the present invention in use.

Turning now descriptively to the drawings, in which similar reference characters denote similar elements throughout the several views, the figures illustrate the Shoes with Interchangeable Appliqués of the present invention. With regard to the reference numerals used, the following numbering is used throughout the various drawing figures.

10 Shoes with Interchangeable Appliqués of the present invention
12 shoe
14 shoe outer sole
16 shoe inner sole
18 shoe vamp
20 vamp lining
22 vamp recess
24 shoe quarter
26 quarter lining
28 quarter recess
30 heel quarter recess
32 open toe shoe
34 decorative appliqué
36 decorative appliqué ornamental element
38 decorative appliqué base
40 decorative appliqué base top surface
42 decorative appliqué base bottom surface
44 snap fastener
46 magnetic fastener
48 zipper fastener
50 hook and loop fastener
52 storage box
54 vamp ridge
56 toe cover appliqué
58 magnets

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1 shown is an illustrative view of the present invention 10 in use. The present invention 10 is a shoe 12 having an outer sole 14, inner sole 16 with vamp 18 and quarters 24 extending therefrom with interior linings 20, 26 covering the vamp and quarters respectively. The present invention provides at least one cavity milled in vamp 18 forming vamp recess 22 and/or milled in quarter 24 forming quarter recess 28, which includes heel quarter recess 30, for placement therein of at least one decorative appliqué 34 for changing the style and appearance of shoe 12. The appliqué comprises a shoe releasable base 38 having a bottom surface 42 and a top surface 40 that may be any texture or color. Further provided is an ornamental element 36 fastened to base 38. At least one fastener selected from the list of snaps 44, magnets 46, zipper 48 and hook and loop 50, typically known under its trade name (Velcro®). Additionally, the present invention envisions that a plurality of swappable appliqués 34 and storage box 52 are provided with the recessed enhanced shoes 12. While there are other appliqués designed for shoes, the present invention provides that the swappable appliqués have substantially similar periphery dimensions as the aforementioned cavities so that once placed therein the decorative appliqué top surface 40 is level with the outer surface of the vamp or quarter. In other words, surface 40 doesn't extend above or below the rim of the cavity and therefore has the appearance that the appliqué was manufactured as an integral part of said shoe 12.

Figure 2:
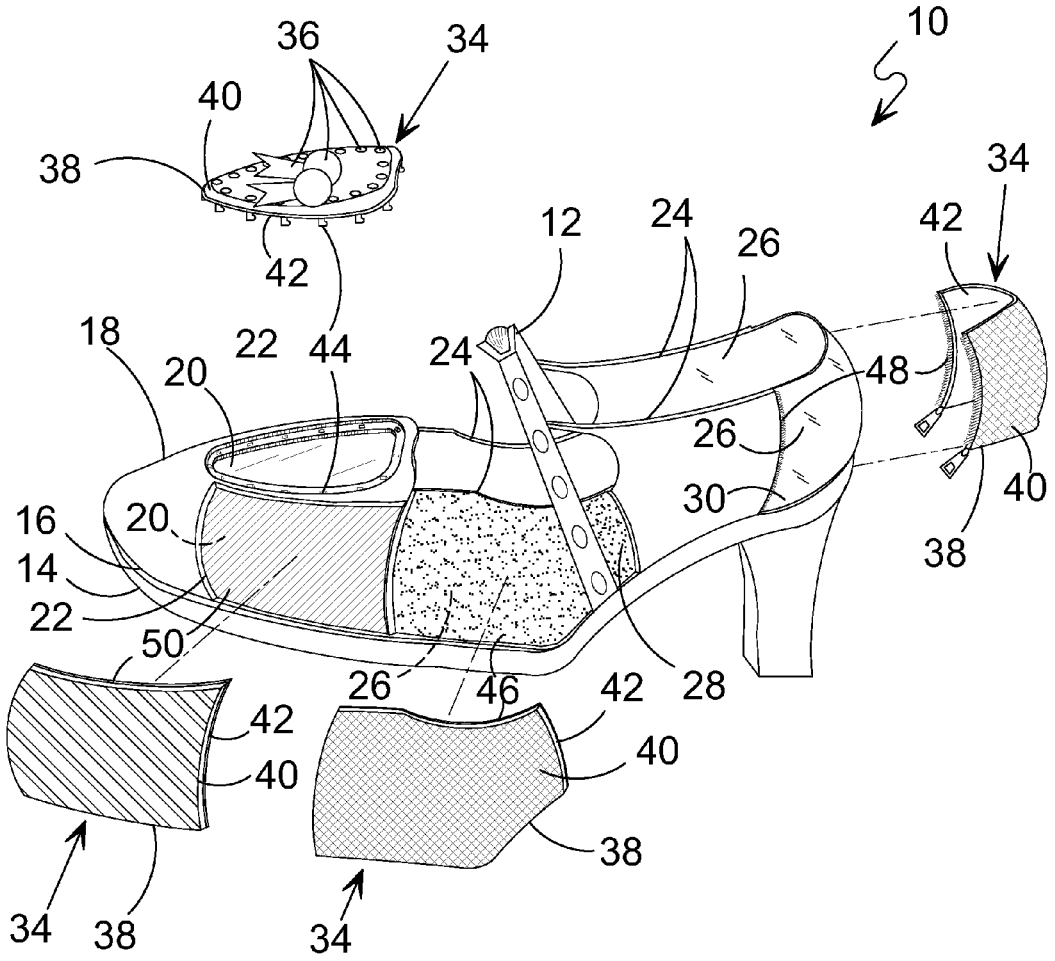
FIG. 2 is an illustrative view of the present invention.

Referring to FIG. 2 shown is an illustrative view of the present invention. Illustrated is a high heel shoe 10 having a plurality of vamp and quarter recesses 22, 28 and a plurality of decorative appliqués 34 with each using a different fastener attachment means 44, 46, 48, and 50 depicting enablement of the various fasteners for illustrative purposes. For purposes of this application the vamp 18 is considered the front part of the shoe extending from the front of the shoe opening to the tip of the shoe with the quarters 24 extending from there through the heel. While enablement of all fasteners is depicted, the preferable fastener is hook and loop. Vamp Recesses 22 are depicted in the top and side of vamp 22. The top side decorative appliqué 34 having top side 40 and bottom side 42 with snap fasteners 44 extending therefrom is positioned for insertion into vamp recess 22. As illustrated, the cavity extends through the vamp's outer layer but not the vamp lining 20. Also shown is the decorative appliqué 34 having ornamental elements 36 fastened thereto. Another vamp recess 22 is shown in the side of shoe 12 with a ready to be inserted decorative appliqué 34 comprising appliqué base 38 having top side 40, which may be any color or texture and bottom side 42 having a first mating hook and loop fastener 50 fixedly attached thereto with the vamp recess 22 having the reciprocal mating hook and loop fastener 50 therein. Further depicted are quarter recesses 28 within the side of shoe 12 and back of shoe 12 herein referred to as a heel recess 30. Each of those recesses are shown with a releasable decorative appliqué 34, one using mating magnetic fasteners 46 and the other using a zipper fastener 48.

Figure 2A:
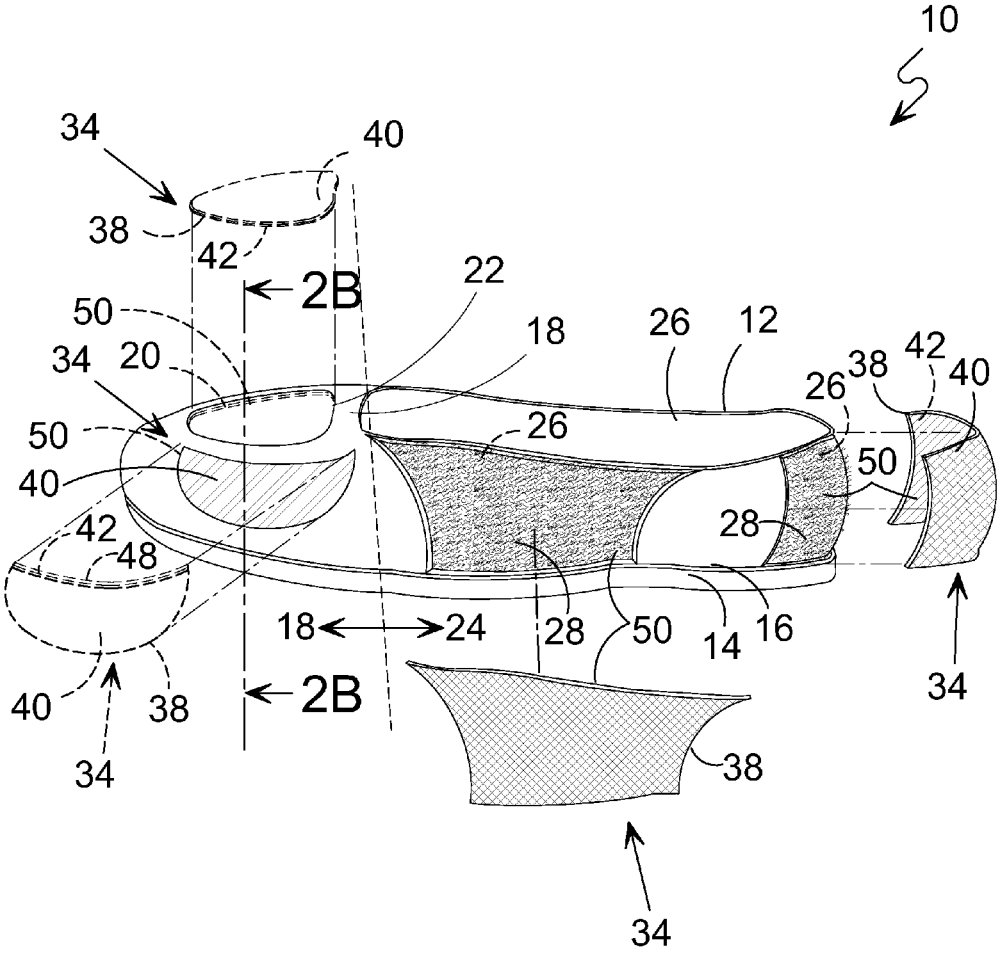
FIG. 2A is a shoe having a plurality of decorative appliqués using hook and loop as the fastening element.

Referring to FIG. 2A, shown is a shoe having a plurality of decorative appliqués using hook and loop as the fastening element. The present invention provides a shoe 12 having at least one milled recess 22, 28 through the shoe's vamp 12 material or quarter 28 material exposing the interior shoe's lining 20, 26 forming receptacle for a decorative appliqué 34 comprising decorative appliqué base 38 having top surface 40 of any color or texture and bottom surface 42 having a first part of a fastening element, in this case hook and loop fastener 50. The present invention further provides that a decorative ornamental element may be fastened to the top surface 40 of appliqué base 38 for any or all appliqué bases.

Figure 2B:
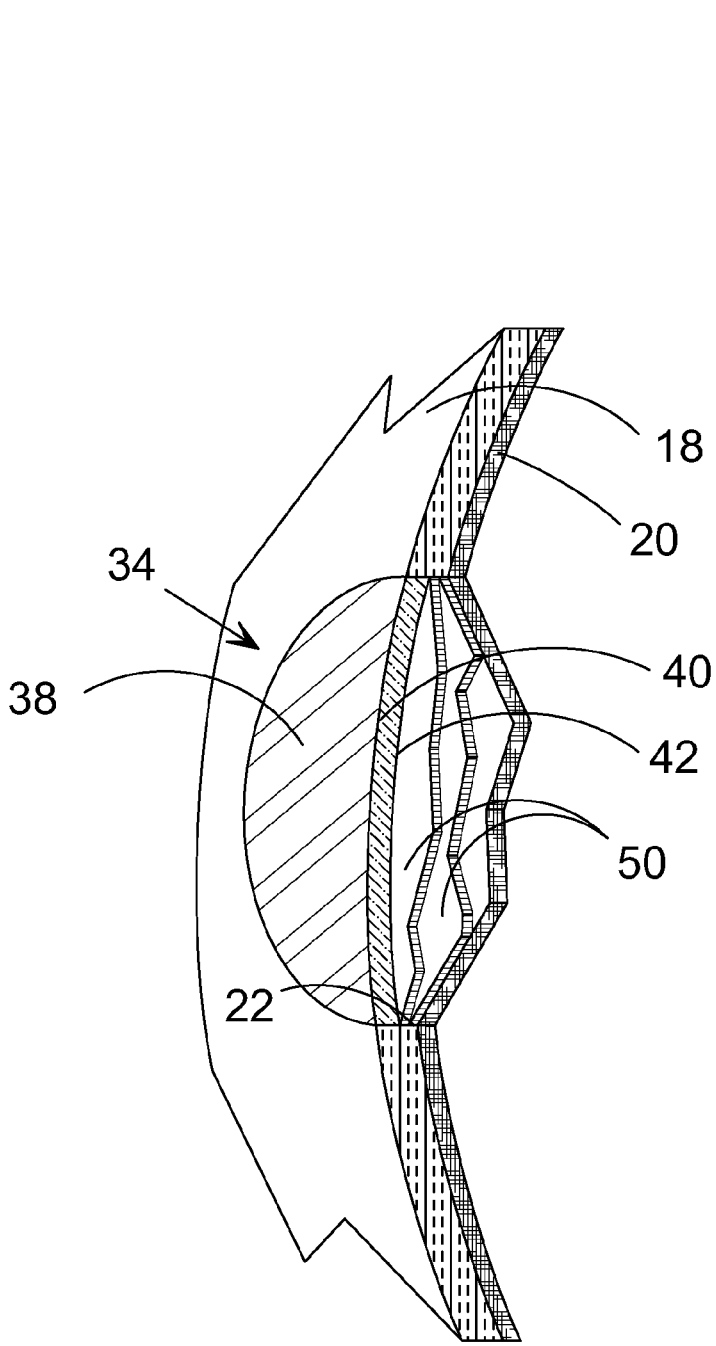
FIG. 2B is a partial sectional view of a shoe installed appliqué, taken from FIG. 2 as indicated.

Referring to FIG. 2B shown is a partial sectional view of a shoe installed appliqué, taken from FIG. 2 as indicated. Illustrated is vamp recess 22 milled in shoe vamp material 18 to the vamp lining 20, which has one of a mating hook and loop fastener 50 fixed to the vamp lining 20. The decorative appliqué 34 comprising base 38 having top side 40, of any color or texture, and bottom side 42 having the mating hook and loop fastener fixed thereto provides for easily removing the decorative appliqué 34 and replacing with a similarly dimensioned decorative appliqué 34. Also shown is the decorative appliqué having its top surface 40 in co-planar alignment with the rim of the shoe vamp 22 recess giving the appearance that the decorative appliqué is an integral part of the shoe.

Figure 3:
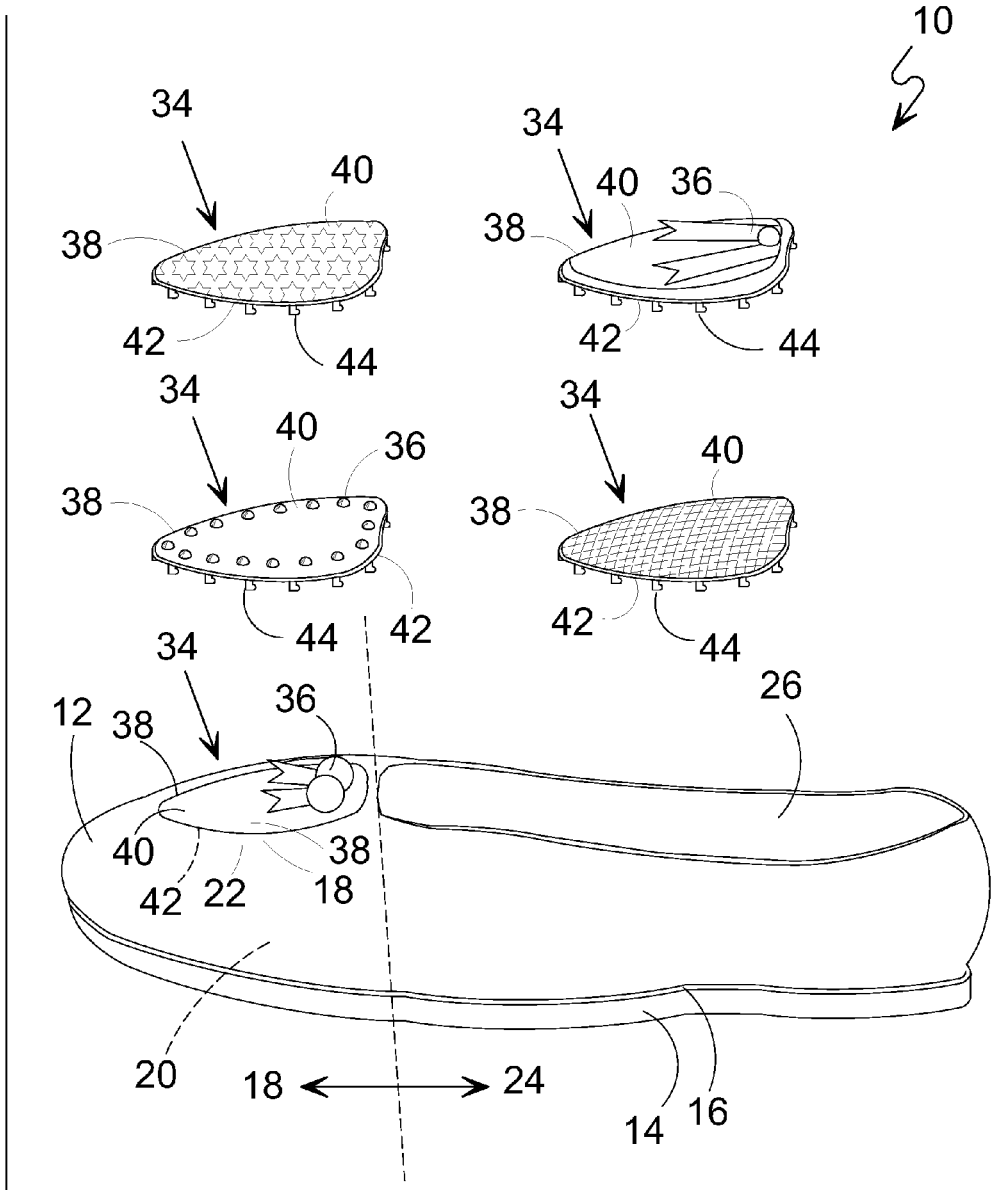
FIG. 3 is an illustrative view depicting a plurality of swappable decorative appliqués for the shoe of the present invention.

Referring to FIG. 3, shown is an illustrative view depicting a plurality of swappable decorative appliqués for the shoe of the present invention. The decorative appliqué 34 of the present invention comprises a decorative appliqué base 38 having a top side 40 and bottom side 42 that may have an ornamental element fixed to the appliqué base top surface 40 and wherein said top surface may be any color or texture. A fastener, taken from the list of snaps, magnets, zipper and hook and loop is fixedly attached to the appliqué bottom side 42. Once the decorative appliqué is inserted into recess 22, the top surface of the decorative appliqué 34 does not extend above or below the rim of recess 22.

Figure 3A:
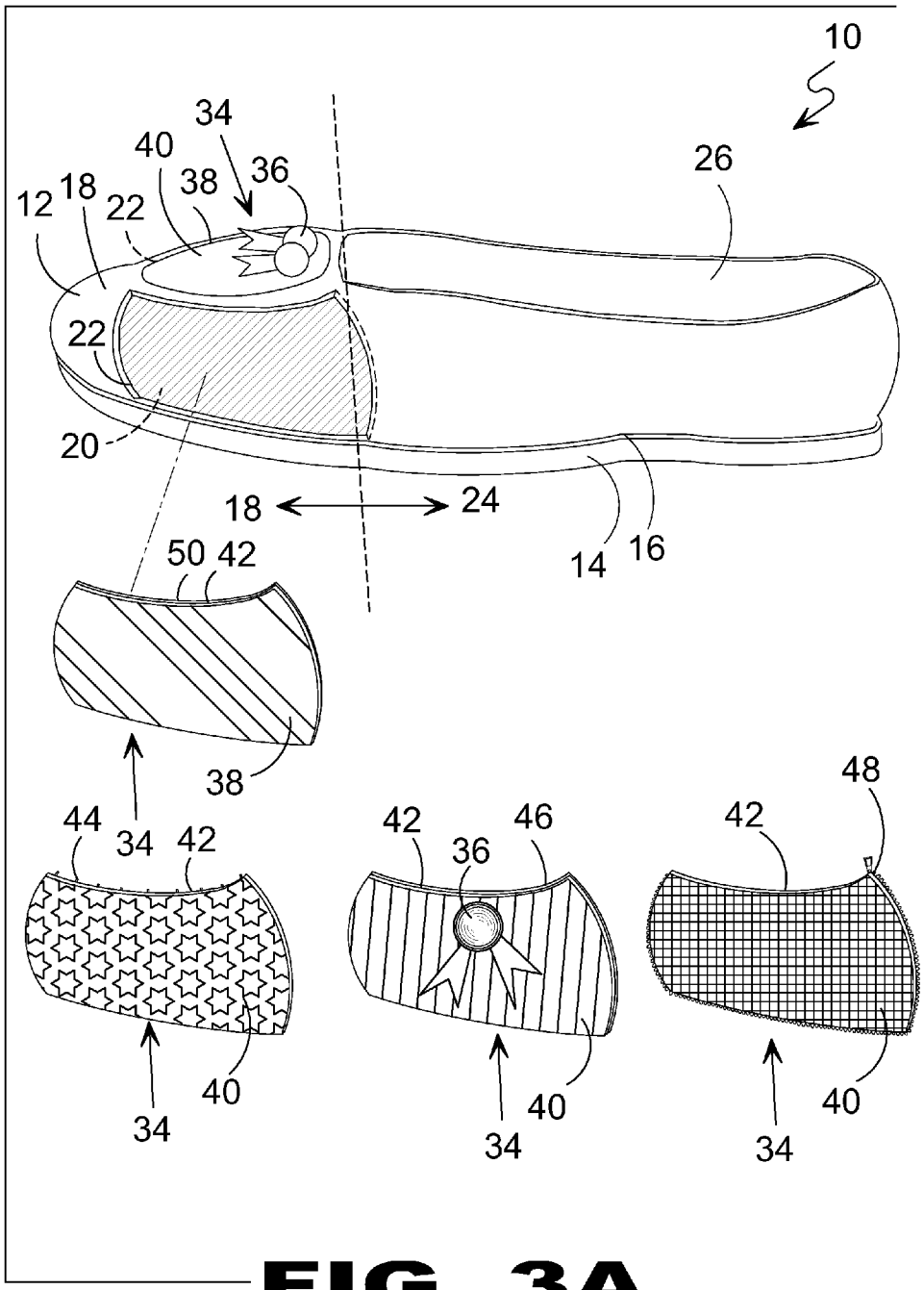
FIG. 3A is a perspective view of the shoe having replaceable decorative elements.

Referring to FIG. 3A, shown is a perspective view of the shoe having replaceable decorative elements. The shoe 12 of the present invention 10 provides multiple changeable decorative elements 34 having releasable fastening means for changing the look of the shoe 12. The decorative appliqués of the present invention comprise a decorative appliqué base 38 having a top surface 40 and a bottom surface 42 that is attachable to a shoe recess 28 using a fastener taken from the list of snaps, magnets, zippers, and hook and loop. The appliqué base top surface 40 may be any color or texture and may incorporate an ornamental element 36 fixed, using any attachment methods known within the art, such as sown, glued, ultrasonically bonded, etc, to the decorative appliqué top surface 40 using a plurality of fastening elements.

Figure 3B:
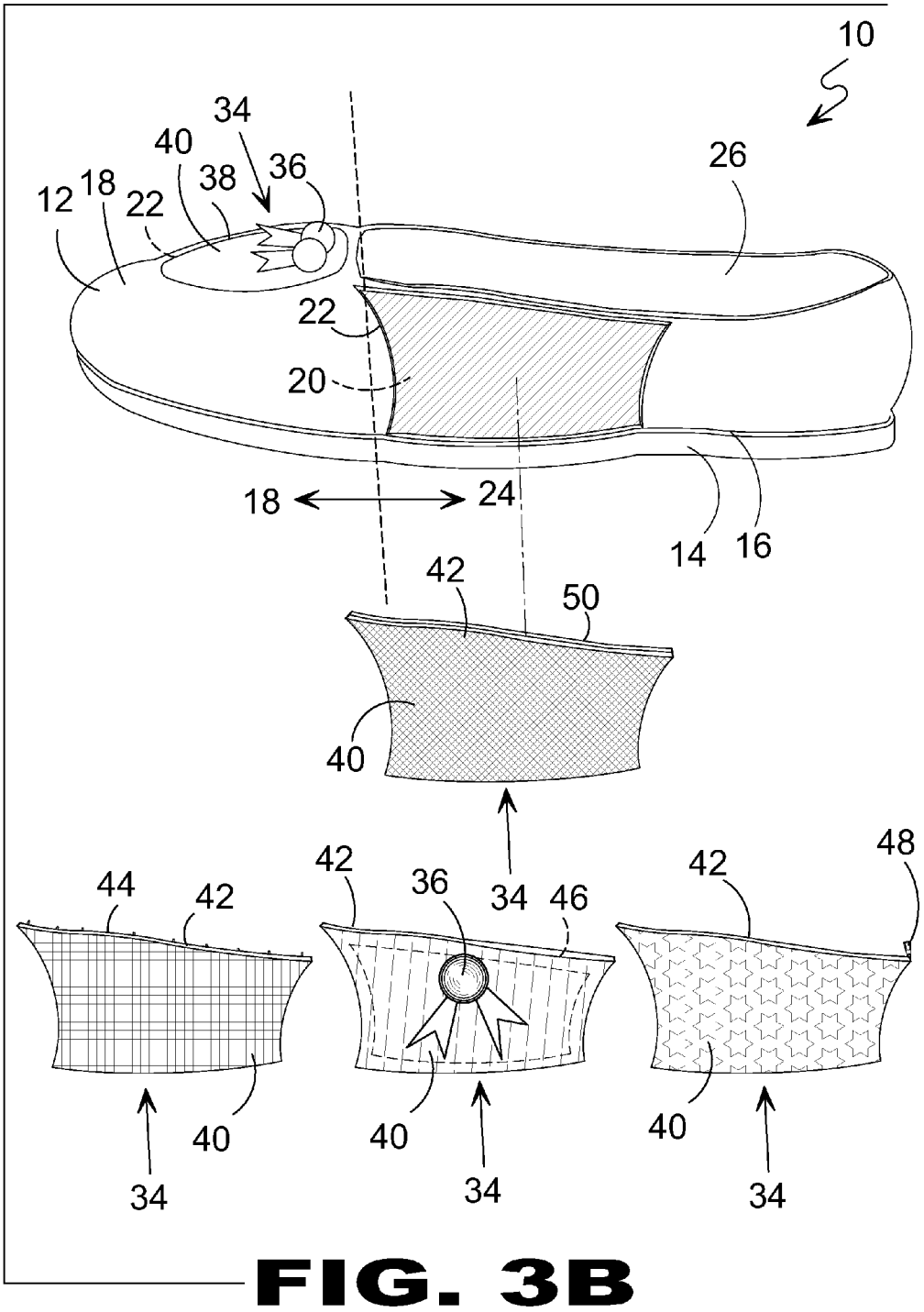
FIG. 3B is another perspective view of the shoe having replaceable decorative elements.

Referring to FIG. 3B, shown is another perspective view of the shoe having replaceable decorative elements. The present invention 10 is a shoe 12 having multiple changeable decorative covers 34 providing for changing the style and appearance of a shoe so that a user can selectively replace the decorative appliqués 34 from a plurality of provided decorative appliqués 34. Shown is a decorative appliqué 34 being secured to the shoe 12 with hook and loop fasteners 50. Other fastener elements may be employed, as illustrated, snaps 44, magnets 46 and zippers 48.

Figure 3C:
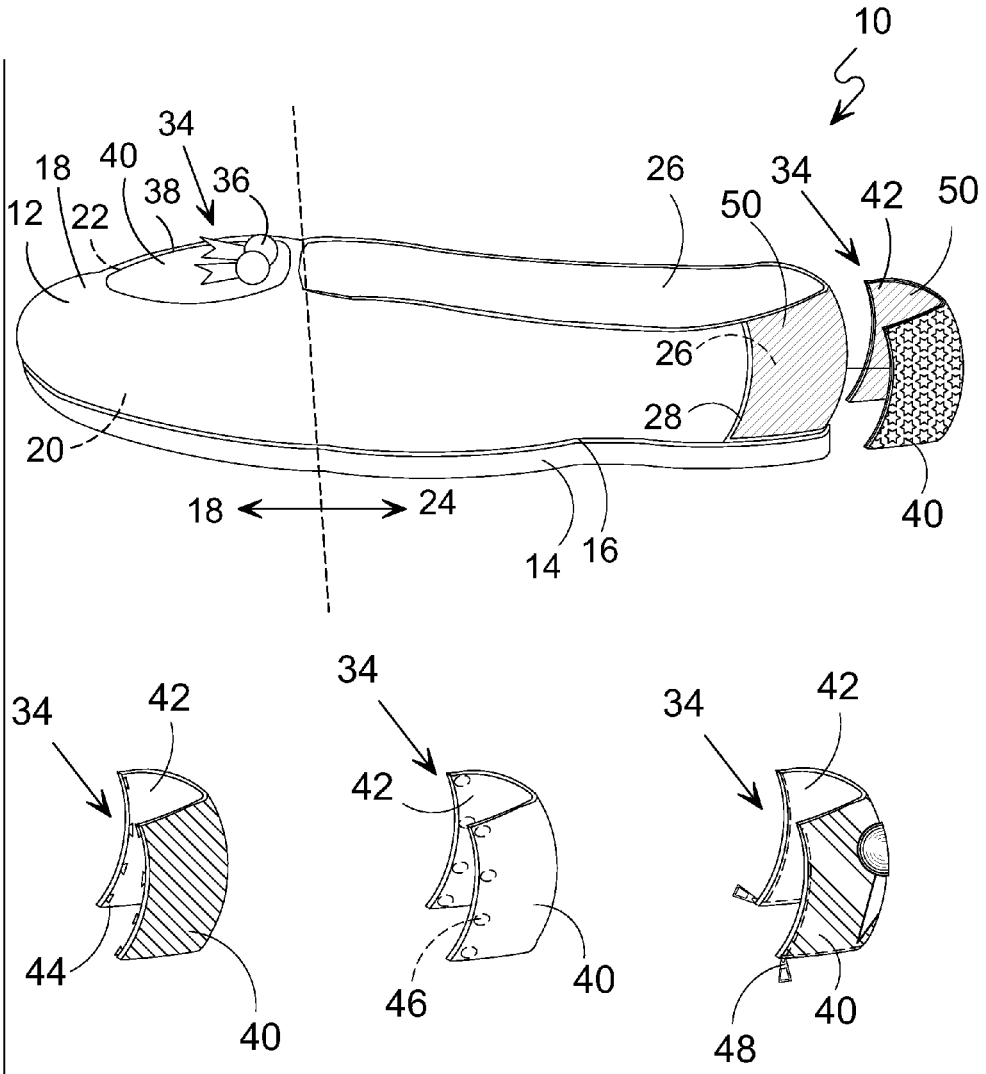
FIG. 3C is another perspective view of the shoe having replaceable decorative elements.

Referring to FIG. 3C, shown is another perspective view of the shoe having replaceable decorative elements. The present invention 10 is a shoe 12 having multiple changeable decorative covers 34 providing for changing the style and appearance of a shoe so that a user can selectively replace the decorative appliqués 34 from a plurality of provided decorative appliqués 34. Shown is a decorative appliqué 34 being secured to the shoe 12 quarter recess 30 with hook and loop fasteners 50. Other fastener elements may be employed, as illustrated, snaps 44, magnets 46 and zippers 48.

Figure 4:
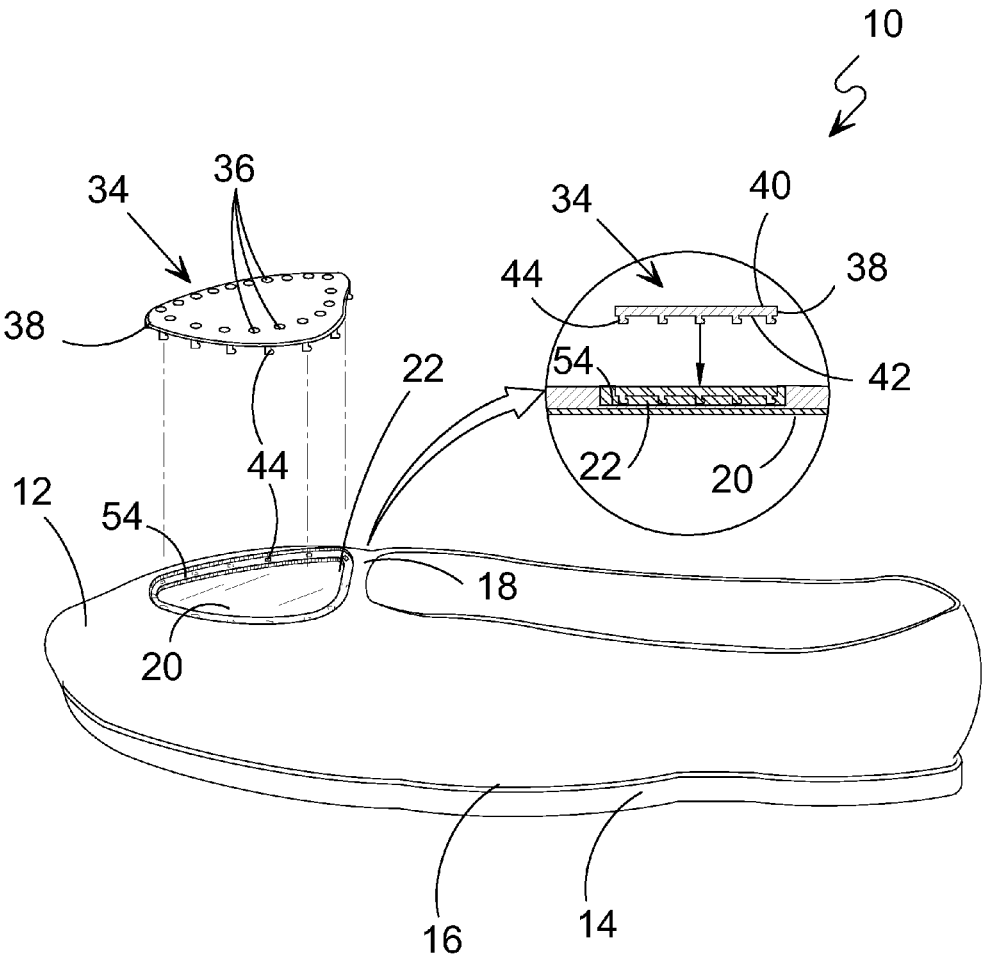
FIG. 4 is an illustrative view depicting decorative appliqués having snap fasteners for the shoe of the present invention.

Referring to FIG. 4, shown is an illustrative view depicting a decorative appliqués having snap fasteners for the shoe of the present invention. The decorative appliqué of the present invention comprising a decorative appliqué base 38 having a top side 40 and bottom side 42 that may have an ornamental element fixed to appliqué base top surface 40 and wherein said top surface 40 may be an color or texture. Fasteners, taken from the list of snaps, magnets, zipper and hook and loop are fixedly attached to the appliqué bottom side 42. Once the decorative appliqué is inserted into recess 22, the top surface of the decorative appliqué 34 does not extend above or below the rim of recess 22. As illustrated, the snap fasteners require vamp material ledge 54 having mating apertures for inserting the post portion of the fastener therein.

Figure 4A:
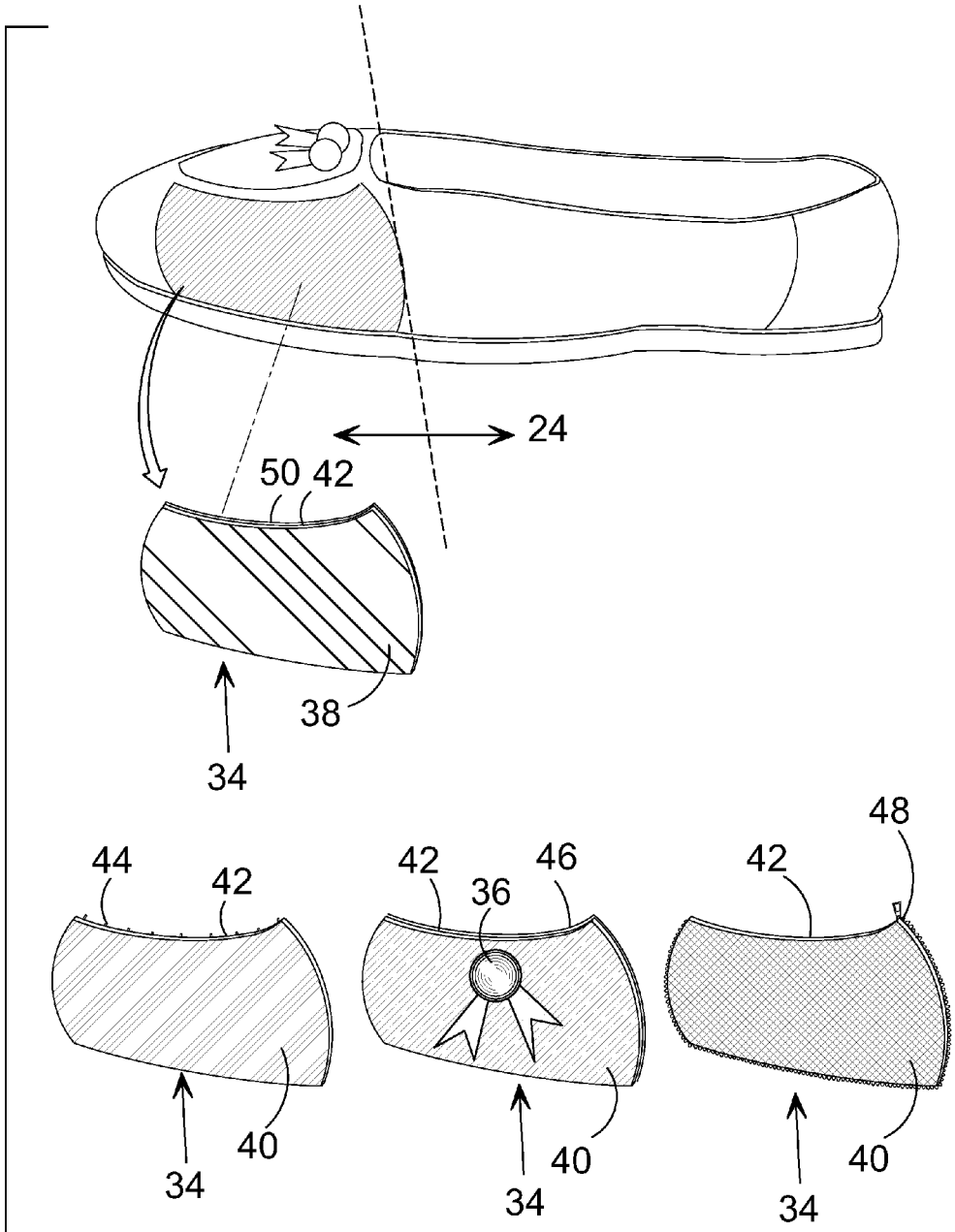
FIG. 4A is a perspective view of the shoe having replaceable decorative elements.

Referring to FIG. 4A, shown is a perspective view of the shoe having replaceable decorative elements. The shoe 12 of the present invention 10 provides multiple changeable decorative elements 34 having releasable fastening means for changing the look of the shoe 12. The decorative appliqués of the present invention comprise a decorative appliqué base 38 having a top surface 40 and a bottom surface 42 that is attachable to a shoe recess 28 using a fastener taken from the list of snaps, magnets, zippers, and hook and loop. The appliqué base top surface 40 may be any color or texture and may incorporate an ornamental element 36 fixed, using any attachment methods known within the art, such as sown, glued, ultrasonically bonded, etc, to the decorative appliqué top surface 40 using a plurality of fastening elements.

Figure 4B:
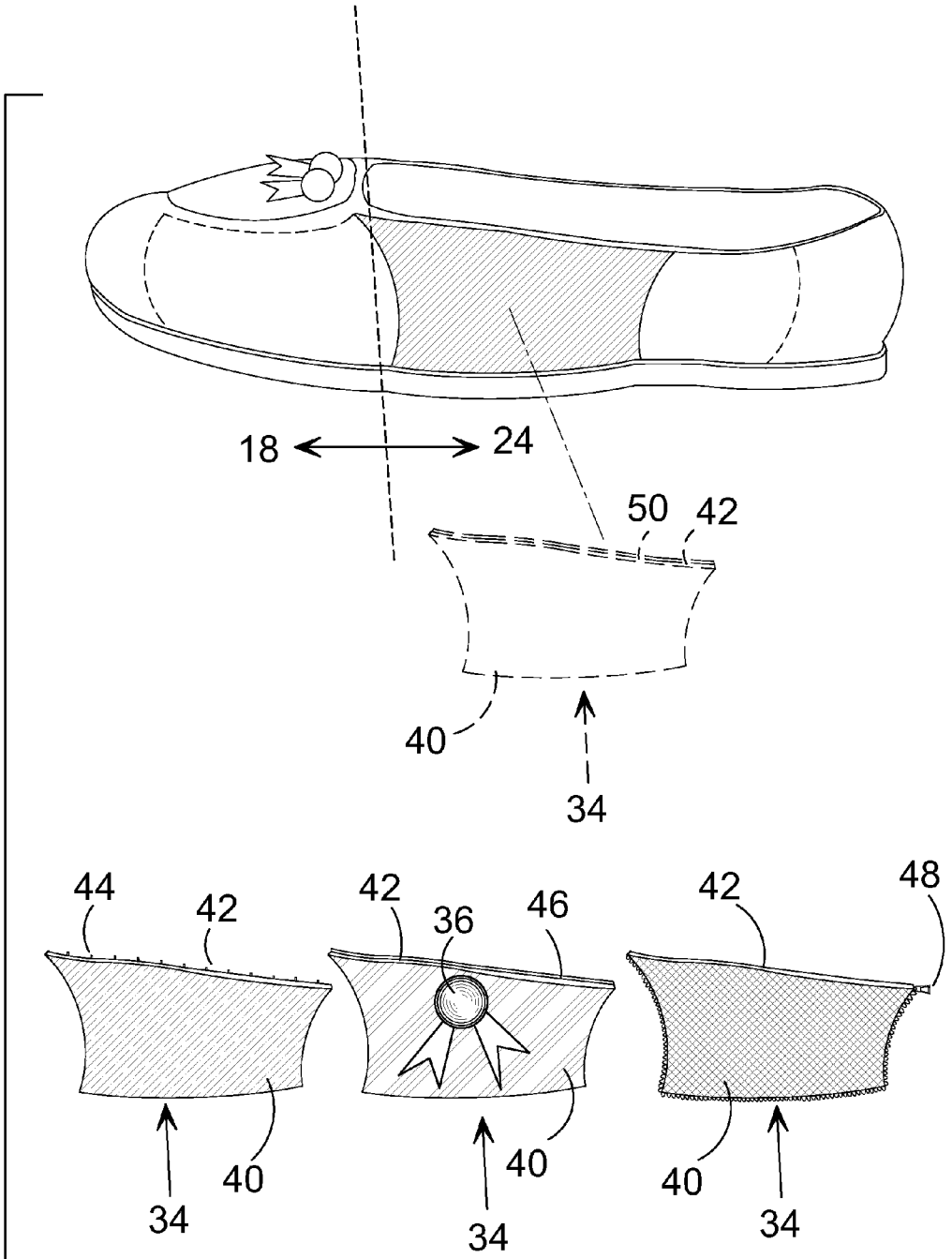
FIG. 4B is another perspective view of the shoe having replaceable decorative elements.

Referring to FIG. 4B, shown is another perspective view of the shoe having replaceable decorative elements. The present invention 10 is a shoe 12 having multiple changeable decorative covers 34 providing for changing the style and appearance of a shoe so that a user can selectively replace the decorative appliqués 34 from a plurality of provided decorative appliqués 34. Shown is a decorative appliqué 34 being secured to the shoe 12 with hook and loop fasteners 50. Other fastener elements may be employed, as illustrated, snaps 44, magnets 46 and zippers 48.

Figure 4C:
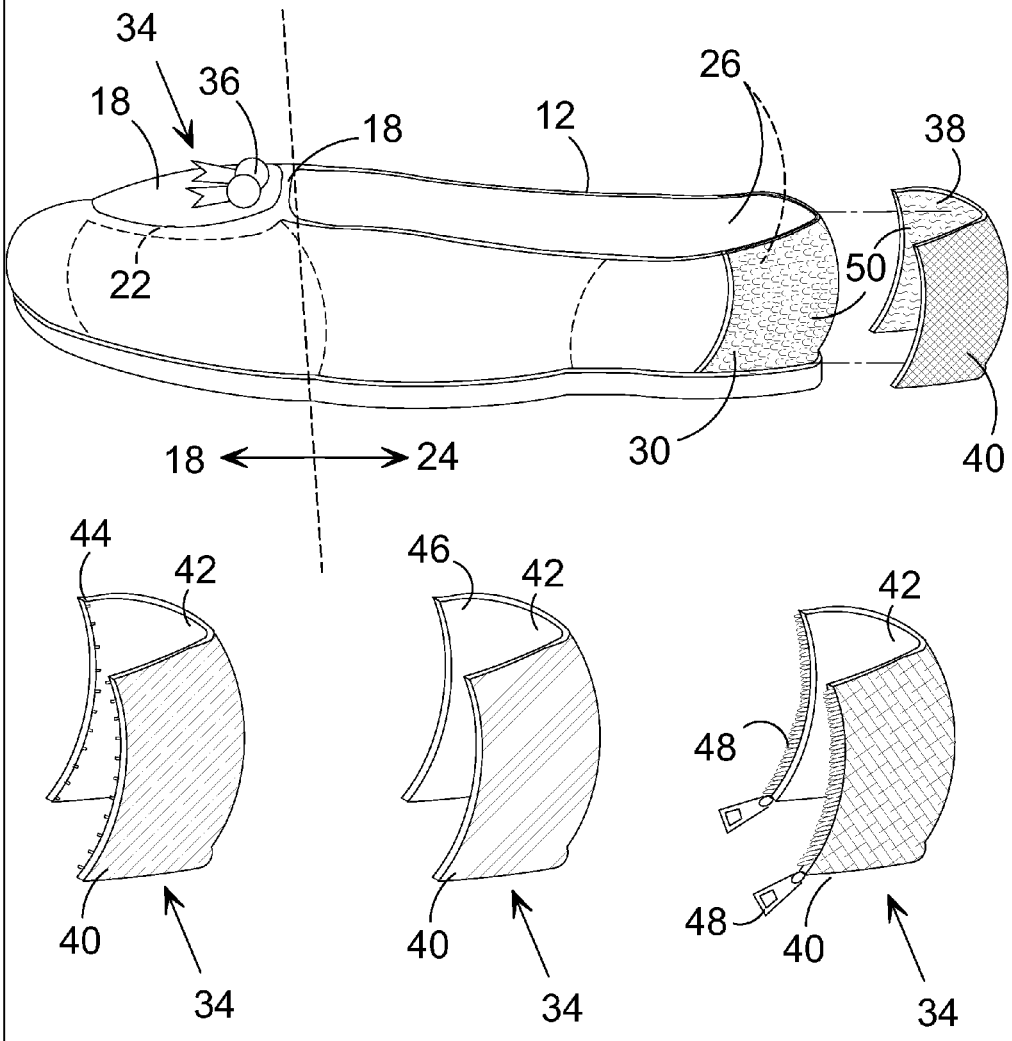
FIG. 4C is another perspective view of the shoe having replaceable decorative elements.

Referring to FIG. 4C, shown is another perspective view of the shoe having replaceable decorative elements. The present invention 10 is a shoe 12 having multiple changeable decorative covers 34 providing for changing the style and appearance of a shoe so that a user can selectively replace the decorative appliqués 34 from a plurality of provided decorative appliqués 34. Shown is a decorative appliqué 34 being secured to the shoe 12 quarter recess 30 with hook and loop fasteners 50. Other fastener elements may be employed, as illustrated, snaps 44, magnets 46 and zippers 48.

Figure 5:
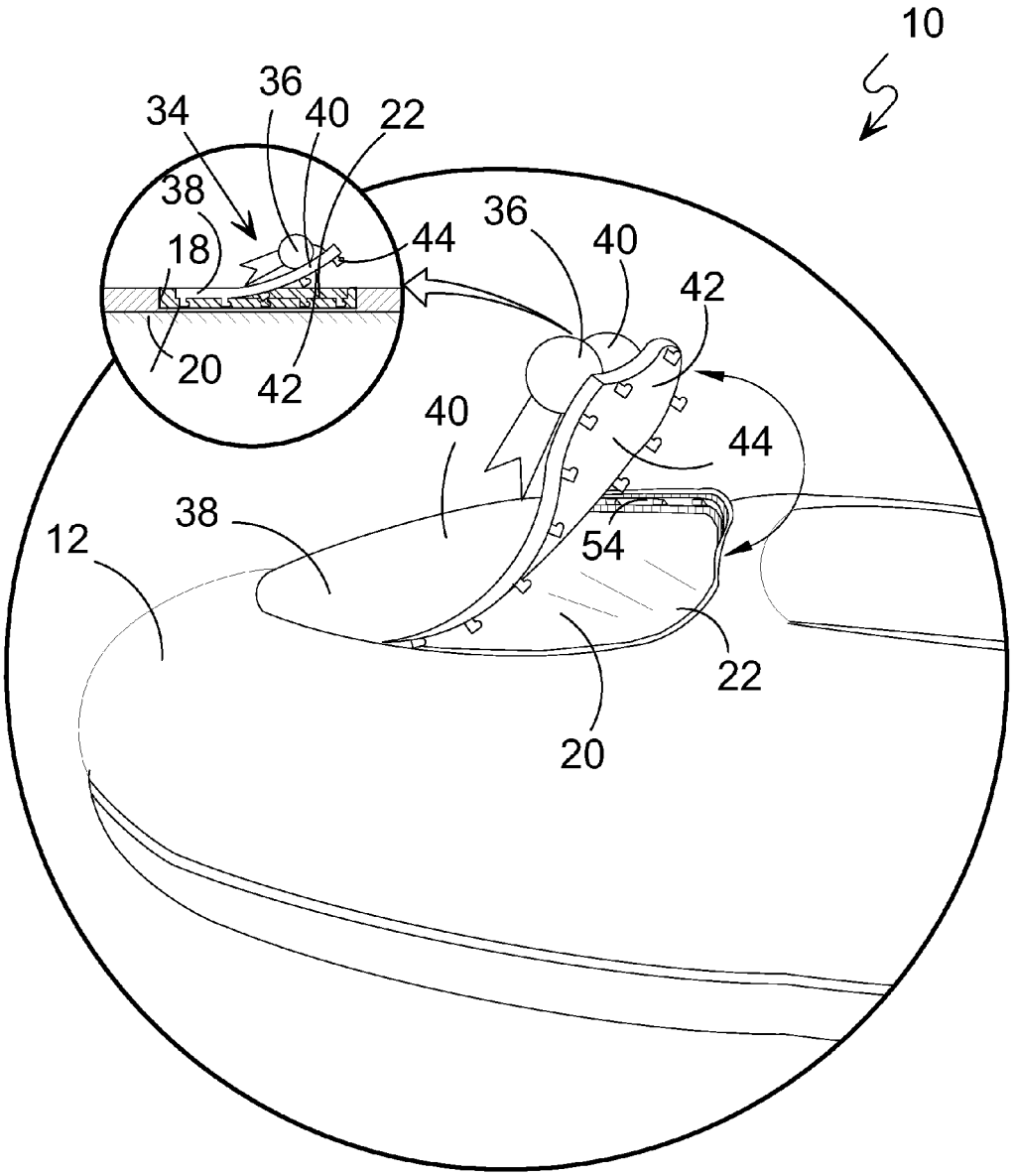
FIG. 5 is an enlarged view of a decorative element partially attached to a shoe.

Referring to FIG. 5, shown is an enlarged view of a decorative element partially attached to a shoe. Shown is the present invention 10, whereby a user can selectively replace the decorative element 34 from a plurality of decorative elements 34. The shoe 12 and decorative appliqué 34 having mating snap attachment means 24 for releasably fixing said top cover 14 to said shoe 12. The removable decorative appliqué 34 can be swapped with different colors and textures to create interesting new looks using the same base shoe 12.

Figure 6:
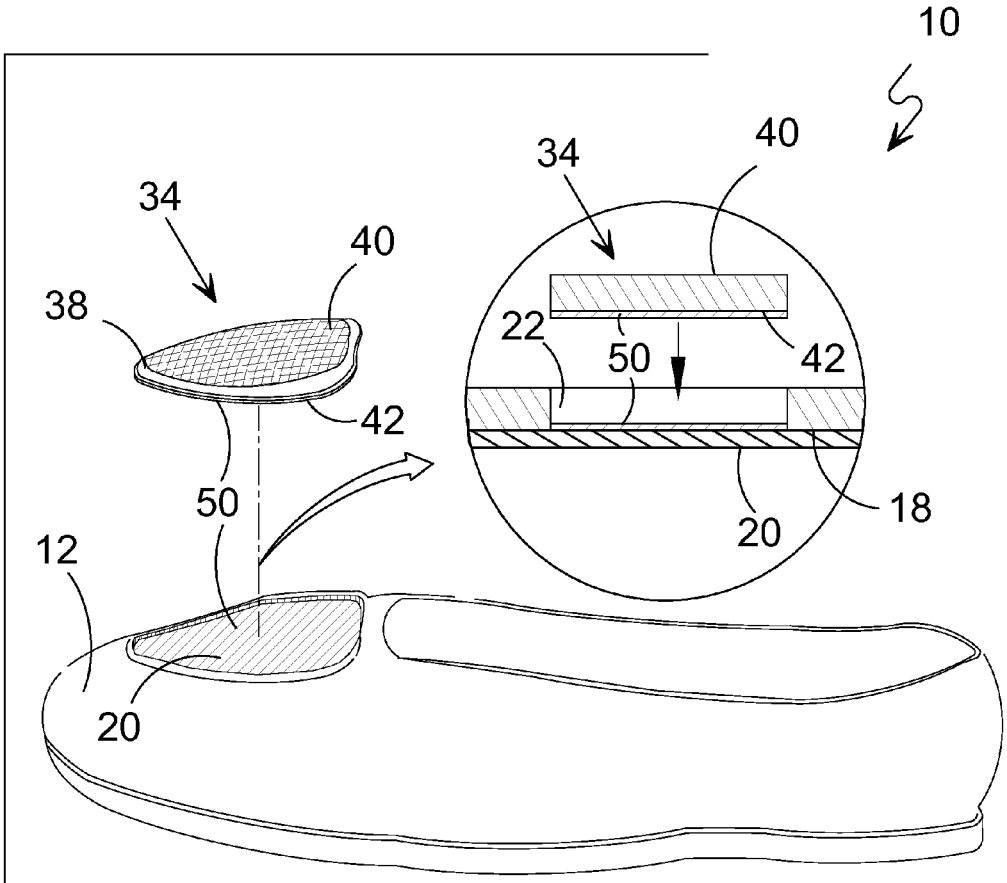
FIG. 6 is another perspective view of the shoe having replaceable decorative elements.

Referring to FIG. 6, shown is another perspective view of the shoe having replaceable decorative elements. The present invention 10 is a shoe 12 having multiple changeable decorative covers 34 providing for changing the style and appearance of a shoe so that a user can selectively replace the decorative appliqués 34 from a plurality of provided decorative appliqués 34. Shown is a decorative appliqué 34 being secured to the vamp recess 22 of shoe 12 with hook and loop fasteners 50. The present invention provides that the swappable appliqués have substantially similar periphery dimensions as the aforementioned cavities so that once placed therein the decorative appliqué top surface 40 is level with the outer surface of the vamp or quarter recess 22, 28.

Figure 7:
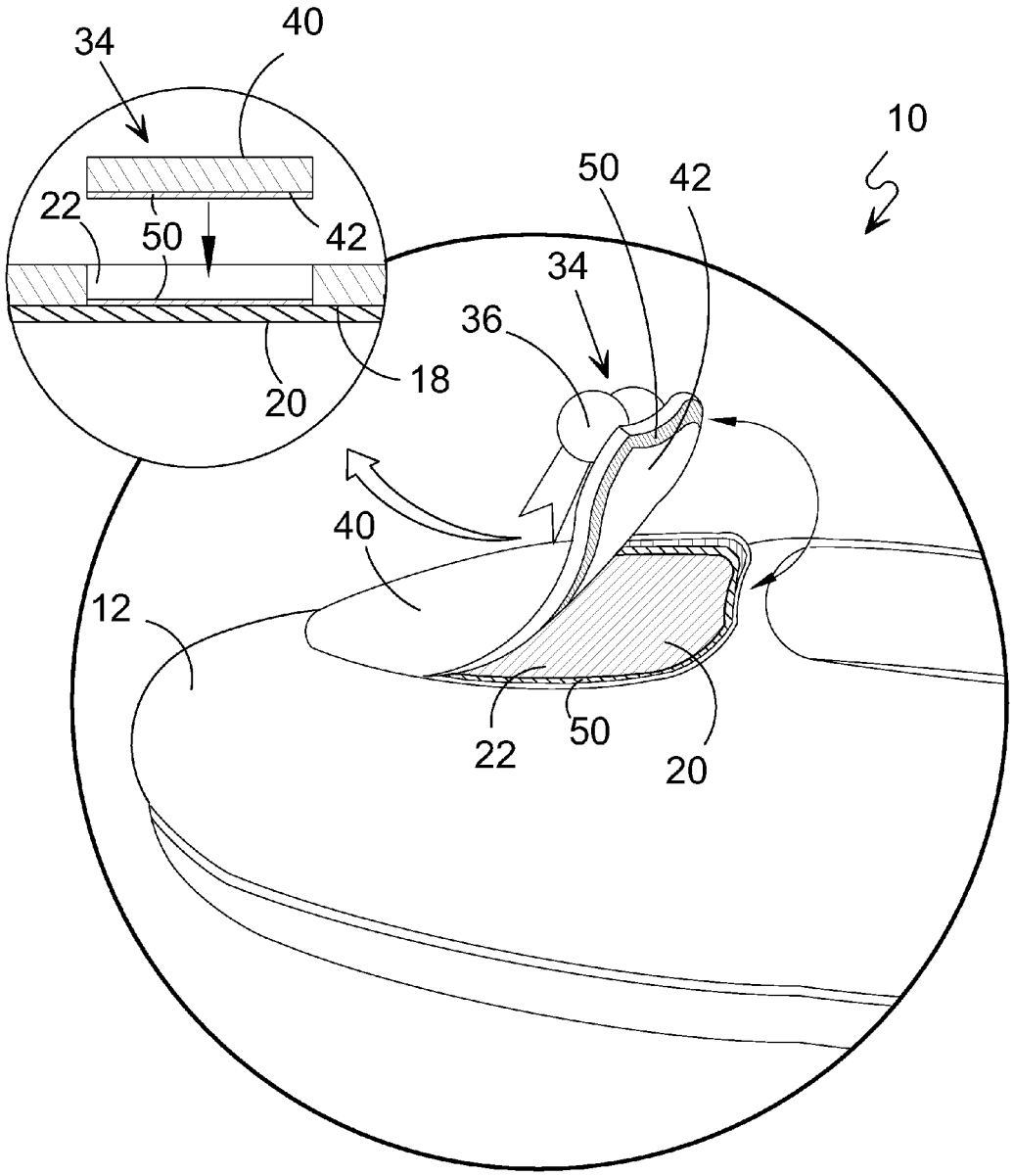
FIG. 7 is an enlarged view of a decorative element partially attached to a shoe.

Referring to FIG. 7, shown is an enlarged view of a decorative element partially attached to a shoe. Shown is the present invention 10, whereby a user can selectively replace the decorative appliqué 34 from a plurality of decorative appliqués 34. Illustrated are the shoe 12 and decorative appliqué 34 having mating snap attachment means 44 for releasably fixing said decorative appliqué 34 to said shoe 12. The removable decorative appliqué 34 can be swapped with other provided decorative appliqués 34 having different colors and textures to create interesting new looks using the same base shoe 12.

Figure 8:
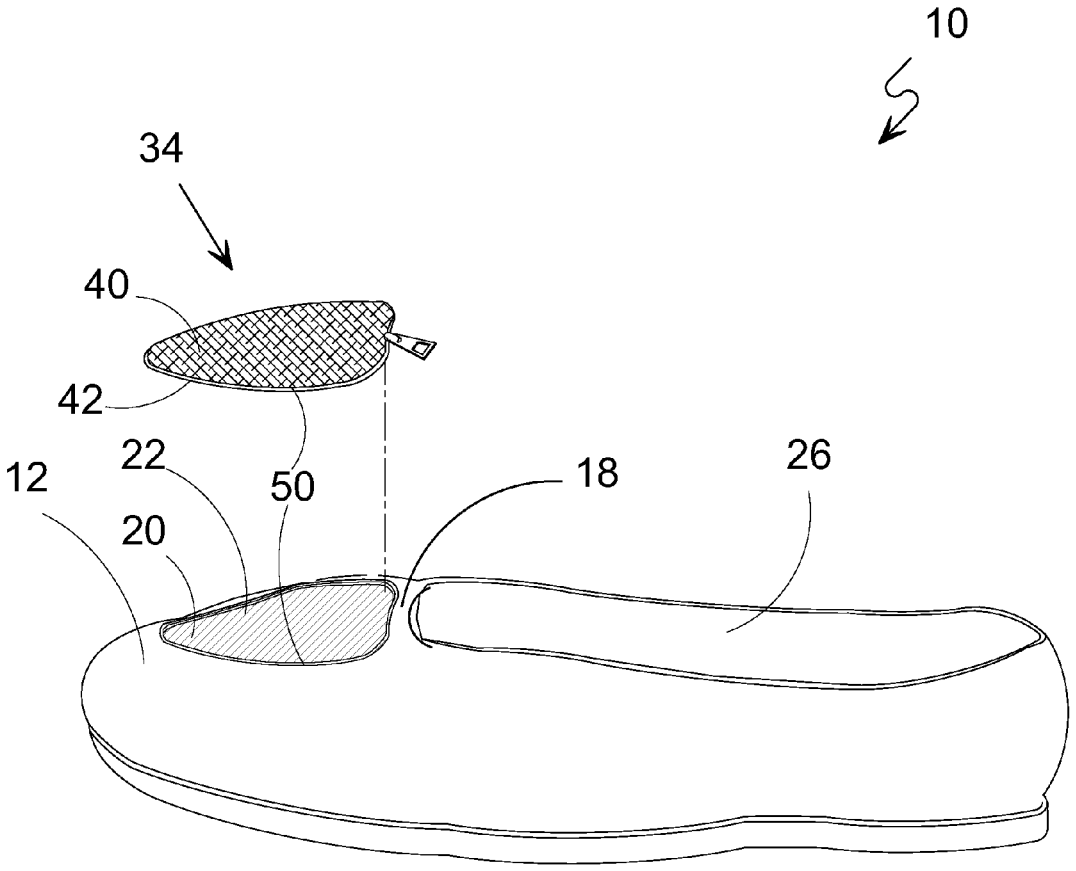
FIG. 8 is an exploded view of the present invention.

Referring to FIG. 8, shown is an exploded view of the present invention 10. Shown is the present invention 10, whereby a user can selectively replace the decorative cover 34 from a plurality of decorative covers 34. Illustrated is the shoe 12 and decorative appliqué 34 having mating zipper means 48 for releasably fixing said decorative cover 34 to said shoe 12. The decorative appliqué 34 comprises a decorative appliqué base 38 having a top side 40 and bottom side 42 that may have an ornamental element fixed to the appliqué base top surface 40 and wherein said top surface may be any color or texture thereby providing a shoe where different colors and textures create a new look for the same base shoe 12.

Figure 9:
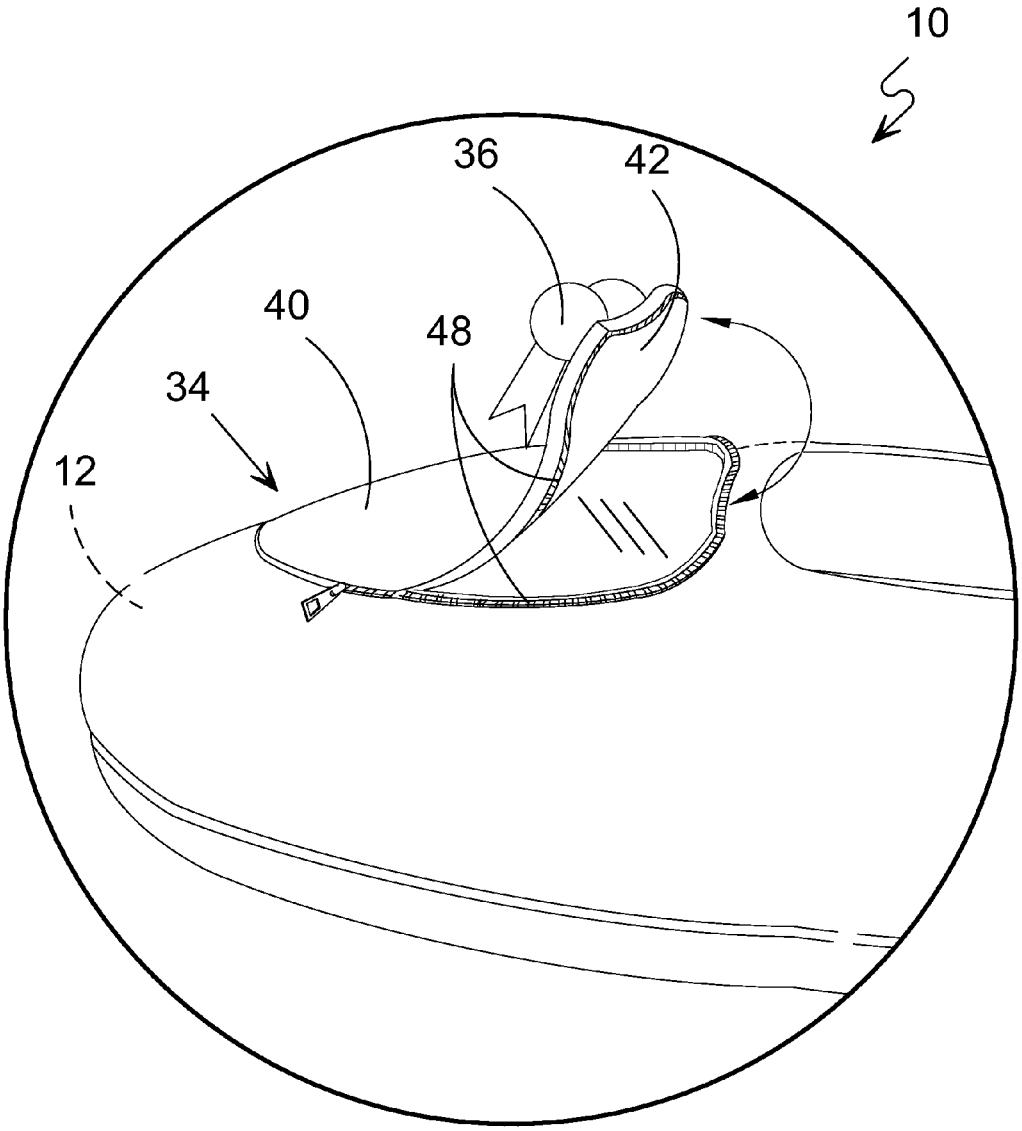
FIG. 9 is a detailed view of the present invention

Referring to FIG. 9, shown is a detailed view of the present invention. Shown is the present invention 10, whereby a user can selectively replace the decorative appliqué from a plurality of provided decorative appliqués 34. The shoe 12 and decorative appliqué 34 having mating zipper means 48 for releasably fixing said decorative appliqué 34 to said shoe 12. The removable decorative appliqué 34 can be swapped with different colors and textures to create interesting new looks using the same base shoe 12.

Figure 10:
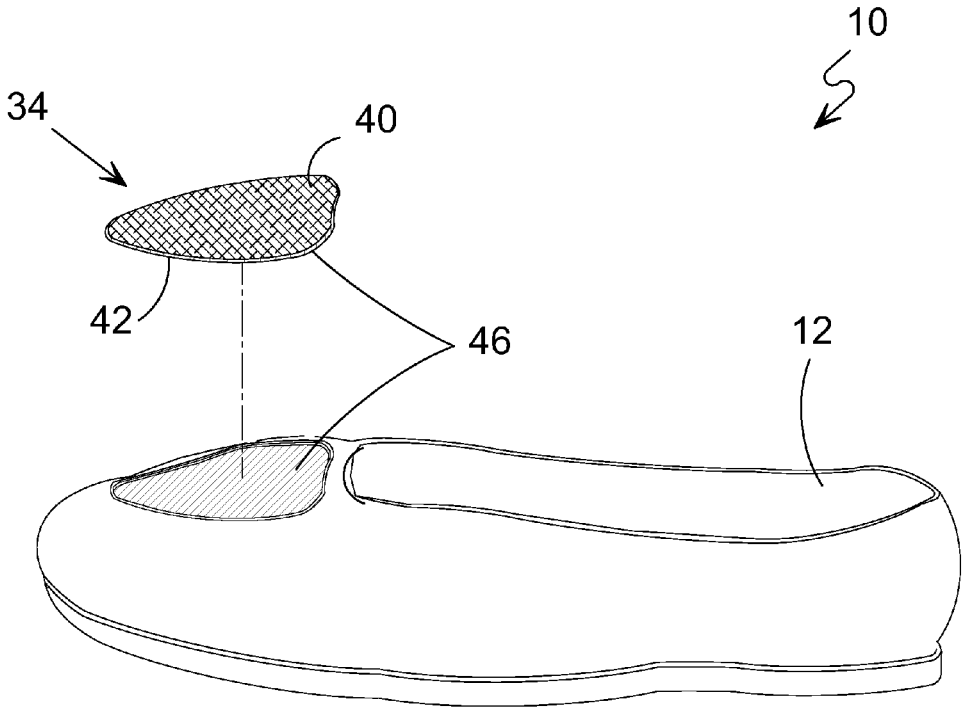
FIG. 10 is an exploded view of the present invention

Referring to FIG. 10, shown is an exploded view of the present invention 10. Shown is the present invention 10, whereby a user can selectively replace the decorative appliqué 34 from a plurality of decorative appliqués 34. Illustrated are the shoe 12 and decorative appliqué 34 having mating magnetic fastening means 46 for releasably fixing said decorative appliqué 34 to said shoe 12. The decorative appliqué 34 comprises a decorative appliqué base 38 having a top side 40 and bottom side 42 that may have an ornamental element fixed to the appliqué base top surface 40 and wherein said top surface may be any color or texture thereby providing a shoe where different colors and textures create a new look for the same base shoe 12.

Figure 11:
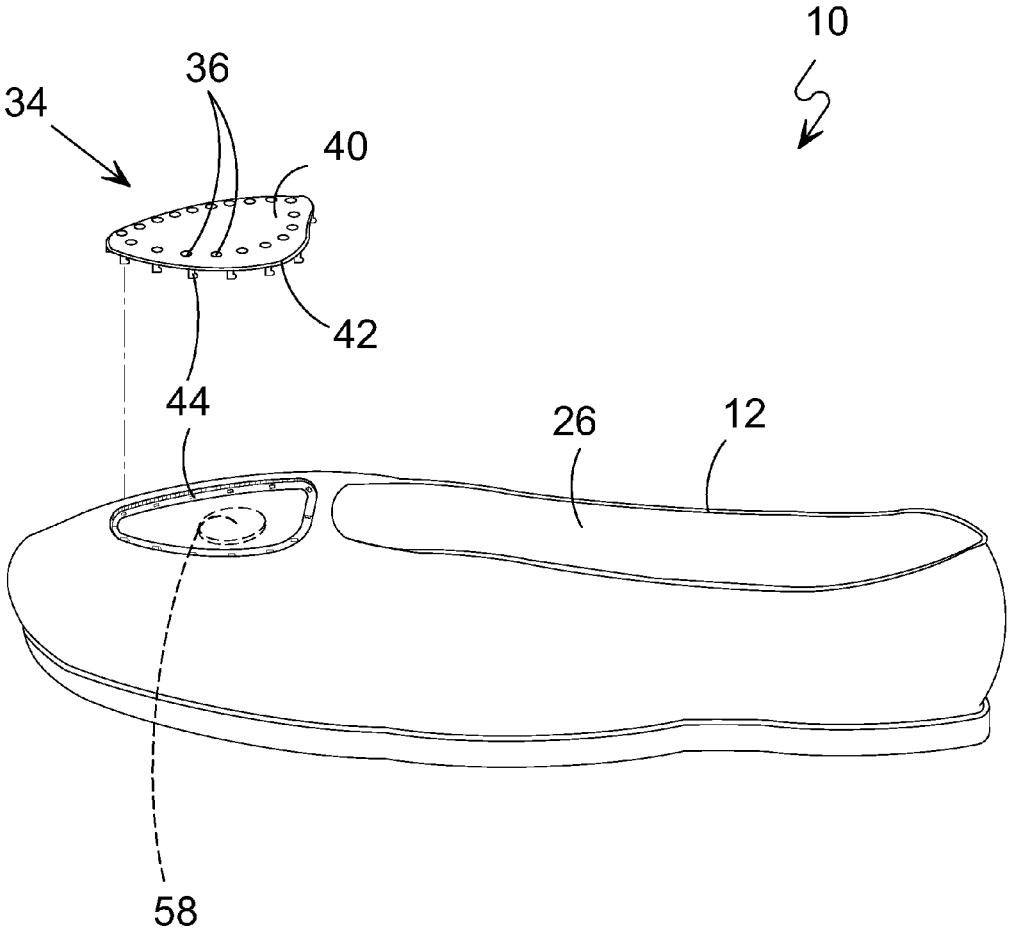
FIG. 11 is a side view of the present invention providing magnetic therapy for feet.

Referring to FIG. 11, shown is a side view of the present invention providing magnetic therapy for feet. Shown is the present invention 10, whereby a user can selectively replace the decorative appliqué 34 from a plurality of provided decorative appliqués 34. Illustrated is the shoe 12 and decorative appliqué 34 having mating snap means 44 for releasably fixing said decorative appliqué 34 to said shoe 12. Interiorly positioned therapeutic magnets 58 may also be provided to provide magnetic therapy to the foot.

Figure 12:
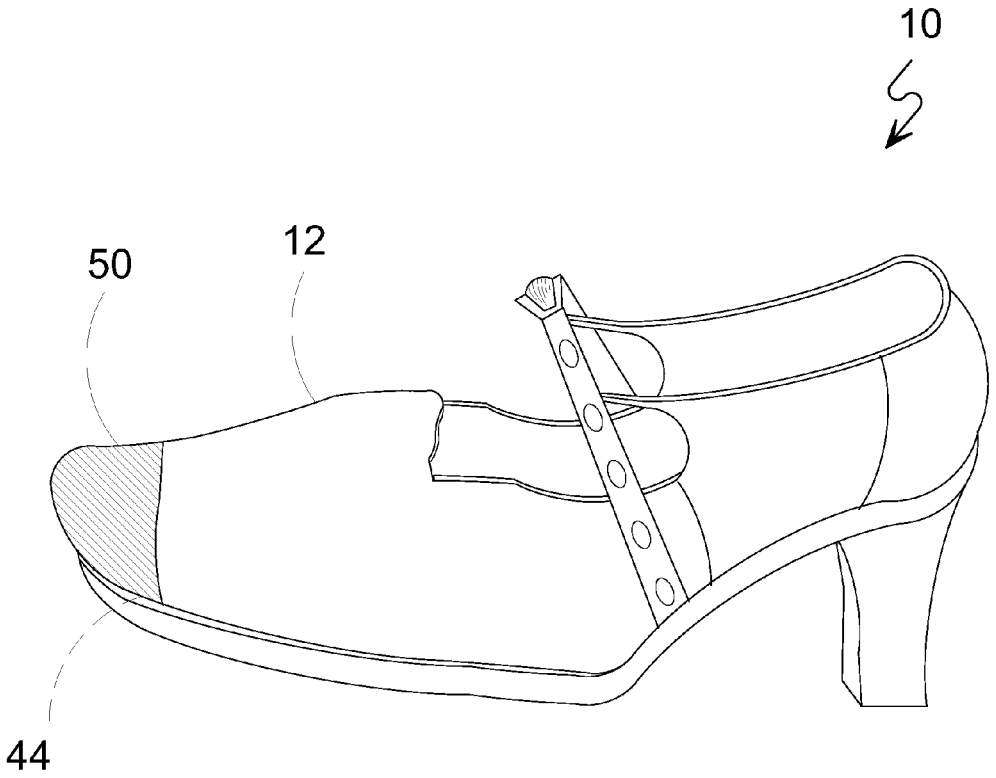
FIG. 12 is an illustrative view of another element of the present invention.

Referring to FIG. 12, shown is an illustrative view of another element of the present invention 10 in use. Shown is a removable peep toe shoe 32 on a high heel style shoe and provided in other style shoes. The removable peep toe tip 56 can be swapped with different colors and textures to create interesting new looks using the same base shoe or left off the shoe, allowing the toes to be open and visible.

Figure 12A:
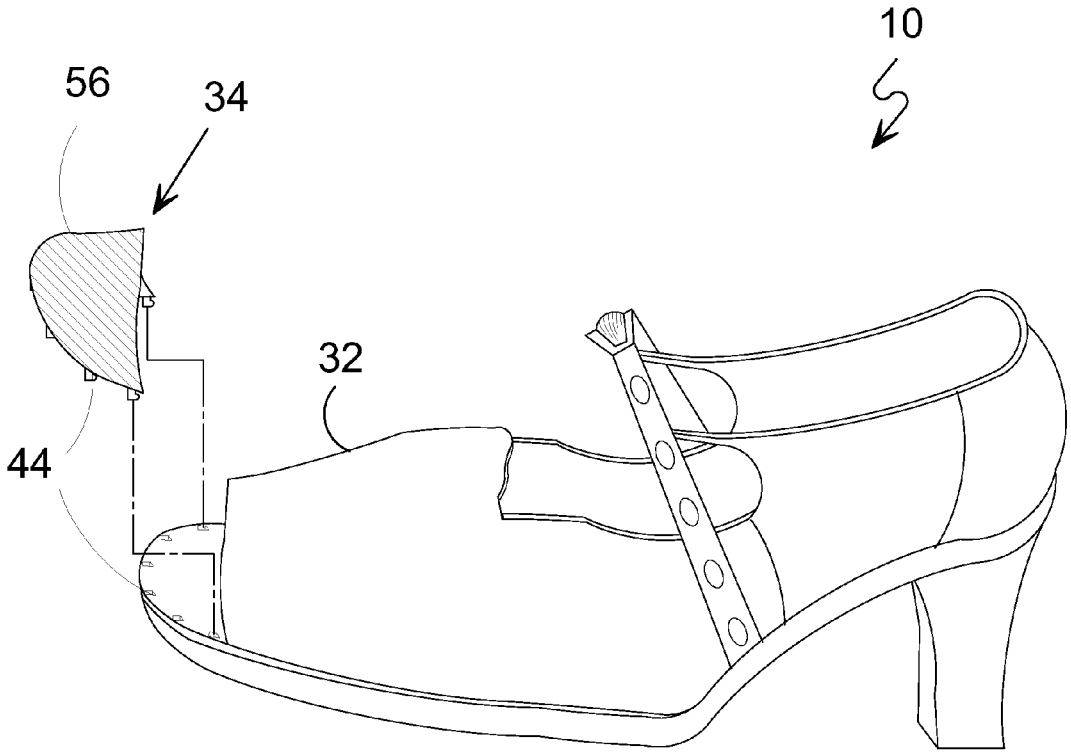
FIG. 12A is an illustrative view of another element of the present invention.

Referring to FIG. 12A, shown is an illustrative view of another element of the present invention 10 in use. Shown is an open toed shoe 32 having a removable peep toe cover appliqué 56 on a high heel style shoe and provided in other style shoes. The removable peep toe tip 56 can be secured using a fastener element taken from the list of snaps, magnets, zippers and hook and loop fastener.

Figure 12B:
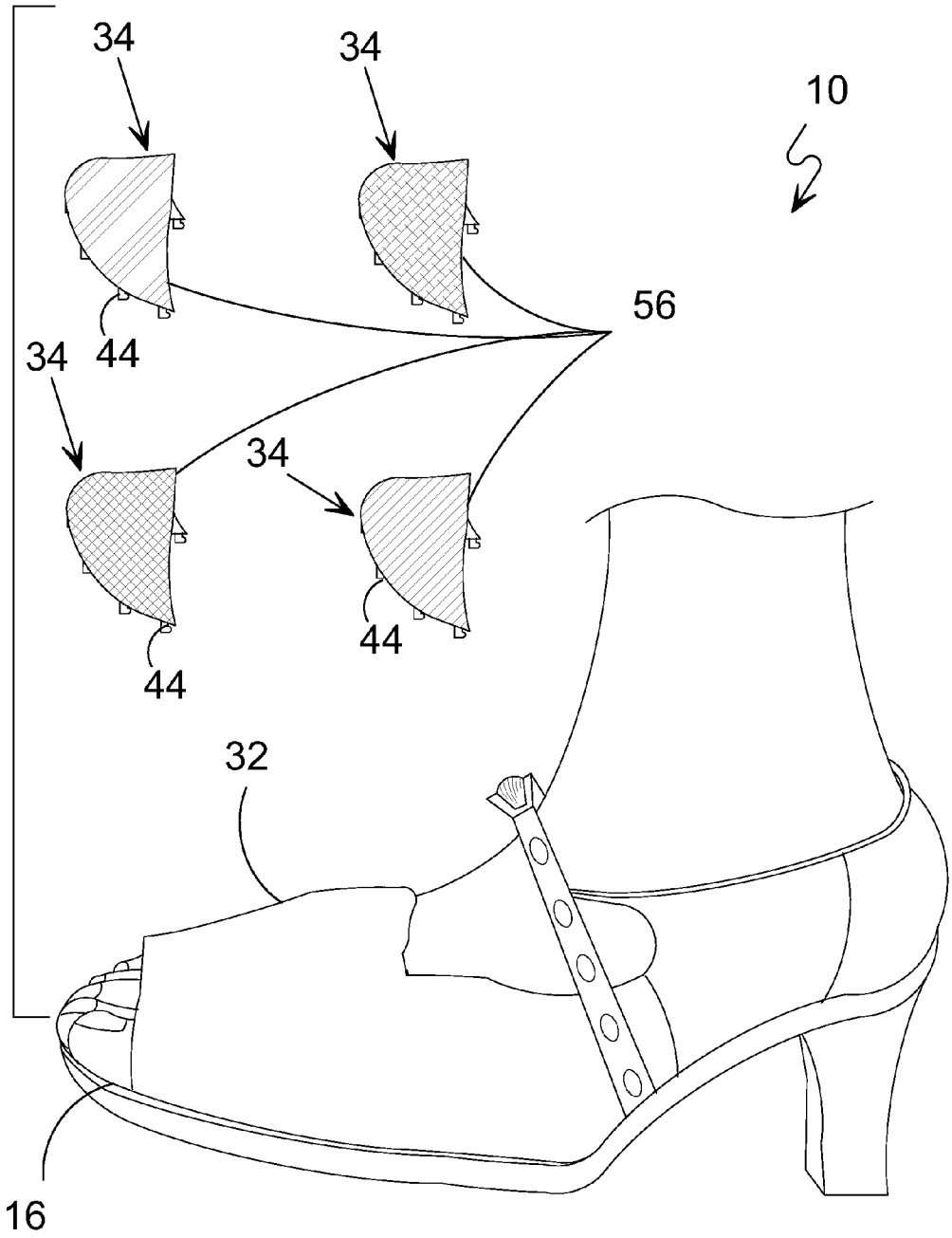
FIG. 12B is an illustrative view of another element of the present invention.

Referring to FIG. 12B, shown is an illustrative view of another element of the present invention. Shown is a removable peep toe appliqué 56 for open toed shoe 32 with high heel style shoe and provided in other style shoes. The removable toe tip 56 can be swapped with different colors and textures to create interesting new looks using the same base shoe or left off the shoe, allowing the toes to be open and visible.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A shoe having a sole and an upper comprised of:

a vamp, vamp lining, quarter and quarter lining with the upper having a first vamp recess for placement therein of a first decorative appliqué;

said first vamp recess being located on an upper surface of said vamp;

a second vamp recess located on a side surface of said vamp extending up from an inner sole of said shoe to near a rim of said first vamp recess for placement therein of a second decorative appliqué, each said vamp recess passing through said vamp and exposing lining of said shoe;

a quarter recess located on a side of said shoe extending up from said inner sole to a foot opening into said shoe, and from close to a rim of said second vamp recess back to said quarter of said shoe for placement therein of a third decorative appliqué, said quarter recess passing through said quarter and exposing lining of said shoe;

a strap for securing said shoe to a foot extending from said inner sole on one side of said shoe to said inner sole on an opposite side of said shoe, said strap passing over said foot opening and said quarter recess;

a heel quarter recess located at a rear of said shoe extending up from said inner sole to said foot opening for placement of a fourth decorative appliqué, said heel quarter recess having an edge on each side of said shoe extending upwardly from an outer sole of said shoe to a foot opening into said shoe, said fourth decorative appliqué having corresponding edges thereof, and a zipper joining each of the corresponding edges of said heel quarter recess and fourth decorative applique;

fastening elements for attaching said appliqués to said shoe located along outer peripheries of said appliqués and rims of said first vamp, second vamp and quarter recesses; and said shoe being a lady's shoe with high heels.

2. The shoe according to claim 1, wherein each said decorative appliqué when positioned within a corresponding recess does not extend above a peripheral rim of said corresponding recess.

3. The shoe according to claim 1, wherein said mating fastener elements is selected from the group consisting of hook and loop, snaps, zipper and magnets.

4. The shoe, according to claim 1, in which said shoe has a front end opening thereby forming a peep toe shoe.

5. The shoe, according to claim 4, further comprising a toe cap having fastening elements for attaching to said inner sole and wherein the top surface of said toe cap is substantially even with the vamp of said open toe shoe.

* * * * *